US005477620A

United States Patent [19]

Barnett

[11] Patent Number: 5,477,620

[45] Date of Patent: Dec. 26, 1995

[54] CHALK DOT MARKER

[76] Inventor: Steve Barnett, 2080 Rusty Hinge Dr., Colorado Springs, Colo. 80920

[21] Appl. No.: 239,441

[22] Filed: May 9, 1994

[51] Int. Cl.[6] ..... B25H 7/04

[52] U.S. Cl. ..... 33/666; 33/669; 33/644

[58] Field of Search ..... 33/528, 666, 669, 33/644, DIG. 10, 579, 668, 578; 116/209, 211

[56] References Cited

U.S. PATENT DOCUMENTS

| | | | |
|---|---|---|---|
| D. 309,156 | 7/1990 | Kuwabara | D19/41 |
| 2,675,625 | 4/1954 | Rayl, Sr. | 33/574 |
| 2,975,520 | 3/1961 | Ericson et al. | 33/578 |
| 3,451,370 | 6/1969 | Matesan | 116/209 |
| 3,874,326 | 4/1975 | Pickens | 116/211 |
| 3,913,235 | 10/1975 | Tenneson et al. | 33/528 |
| 4,144,651 | 3/1979 | De Baun | 33/578 |
| 4,338,724 | 7/1982 | Johnson | 33/528 |
| 4,345,381 | 8/1982 | Brislin | 33/DIG. 10 |
| 4,589,211 | 5/1986 | Policka | 33/669 |
| 4,864,732 | 9/1989 | Landy | 33/666 |

FOREIGN PATENT DOCUMENTS

| | | | |
|---|---|---|---|
| 713829 | 11/1941 | Germany | 33/666 |

*Primary Examiner*—Thomas B. Will

[57] ABSTRACT

A chalk dot marker including a soft foamlike cylinder having a central hole and furthermore being impregnated throughout with marking substance such as powdered chalk. An end of the foamlike cylinder has an adhesive surface layer thereupon attaching to an existing assembly and an impermeable membrane disposed upon an opposing surface. The chalk dot marker is adhesively attached to an assembly which is to be affixed to a surface requiring drilled holes. The assembly is positioned upon the surface and force is applied wherein the force compresses the chalk dot marker thereby releasing marker materials which form a dot at the center thereof.

7 Claims, 4 Drawing Sheets

CHALK DOT MARKER

BACKGROUND OF THE INVENTION

1. Field of the Invention

The present invention relates to surface marking systems and more particularly pertains to a chalk dot marker which may be employed to mark drill sites on a surface receiving a pre-assembled item.

2. Description of the Prior Art

The use of marking apparatus is known in the prior art. More specifically, marking apparatus heretofore devised and utilized for marking drill sites on a surface are known to consist basically of familiar, expected and obvious structural configurations, notwithstanding the myriad of designs encompassed by the crowded prior art which have been developed for the fulfillment of countless objectives and requirements.

The present invention is directed to improving devices for a chalk dot marker in a manner which is safe, secure, economical and aesthetically pleasing.

For example, U.S. Pat. No. 3,874,326 to Pickens discloses a surface release dye marker comprising a cylindrical body containing a water soluble dye and a spring mechanism disengaging at great depth whereby the dye is released upon ascent to a shallower depth. The Pickens invention has no application in marking drill sites upon a surface. The present invention provides a chalk dust dot indication of a drill site on surfaces such as found in automotive exteriors.

In U.S. Pat. No. 3,744,412 to Grue et al. a stencil type chalk fabric marker is disclosed. The Grue et al. invention comprises a series of horizontally disposed stencil stations receiving powdered chalk driven by compressed air to mark an item contactingly disposed over the stencil. The Grue et al. invention is not generally portable and furthermore not generally employable to mark a drill site for an assembly to be affixed to a surface such as an automobile exterior rather the Grue et al. invention is generally employed to produce complex outlines of chalk on various materials. The present invention is employed to produce chalk dots at drill sites for application of assemblies to surfaces such as found on automobiles.

In U.S. Pat. No. 3,451,370 to Matesan a drill hole marker plug is described. The Matesan invention comprises a plug having a centrally disposed telescoping marking member wherein the plug is fitted within a blasting type borehole and employed to provide visual identification of the location of the borehole thereby reducing the chance of damaging the hole and the time required to find a borehole after a frequently encountered period of substantial delay incurred between drilling and charging said borehole. The present invention has no application in siting or marking boreholes for blasting operations rather it is devised for marking drill hole sites for affixing assemblies to surfaces such as an automobile exterior.

In U.S. Pat. No. 4,520,571 to Harding a base plate bolt hole marker is disclosed for marking bolt hole sites on construction type base plates wherein the bolt exists in a slab type construction and a wooden base plate is positioned near the bolt having the base plate bolt hole marker disposed thereon. A disadvantage in this prior art lies in a lack of provision for marking a surface when the bolt member is not yet installed and furthermore when an assembly is engage the surface wherein the bolt hole is to be drilled. The present invention comprises a chalk dot marker which attaches to an apparatus of intended installation upon a surface to be drilled for bolt installation therethrough.

U.S. Pat. No. Des. 309,156 to Kuwabara discloses the ornamental design of a chalk marker. The disclosure teaches a tapering tubular structure having a chalk distributing element at one end thereof and a cap member at an opposing end. The disclosure makes no provision for marking a surface with a chalk dot wherein said chalk dot is positioned in a correct location for installation of a bolt member engaging apparatus attaching thereon. Furthermore, there are no provisions for adhesively applying the chalk marker to engaging apparatus. The present invention comprises a chalk dot making device adhesively attaching to an engaging apparatus and enabling the production of one or more chalk dot marks upon a surface wherein the engaging apparatus is to be boltedly installed.

In this respect, the chalk dot marker according to the present invention substantially departs from the conventional concepts and designs of the prior art, and in so doing provides an apparatus primarily developed for the purpose of generating a dotlike chalk mark on a surface wherein said chalk mark is substantially aligned with a bolt engaging hole disposed upon an assembly to be boltedly affixed to the surface.

Therefore, it can be appreciated that there exists a continuing need for a new and improved chalk dot marker which can be employed to mark drill sites for the installation of assemblies to a surface. In this regard, the present invention substantially fulfills this need.

As illustrated by the background art, efforts are continuously being made in an attempt to improve marking techniques. No prior effort, however, provides the benefits attendant with the present invention. Additionally, the prior patents and commercial techniques do not suggest the present inventive combination of component elements arranged and configured as disclosed and claimed herein.

The present invention achieves its intended purposes, objects, and advantages through a new, useful and unobvious combination of method steps and component elements, with the use of a minimum number of functioning parts, at a reasonable cost to manufacture, and by employing only readily available materials.

SUMMARY OF THE INVENTION

In view of the foregoing disadvantages inherent in the known types of chalk markers now present in the prior art, the present invention provides an improved chalk dot marker construction wherein the same can be utilized for producing chalk marks on a surface indicative of the drill sites for attachment of an assembly thereon. As such, the general purpose of the present invention, which will be described subsequently in greater detail, is to provide a new and improved chalk dot marker apparatus and method which has all the advantages of the prior art markers and none of the disadvantages.

The invention is defined by the appended claims with the specific embodiment shown in the attached drawings. For the purpose of summarizing the invention, the invention may be incorporated into a ring of flexible foamlike material impregnated with chalk dust and having an adhesive coated first surface and an impermeable barrier second surface in parallel disposition thereon. In operation the chalk dot marker is adhesively applied to an assembly at one or more bolt engagement sites. The assembly is then placed in final position and force is applied thereon to squeezably flatten the chalk dot markers disposed thereon. Upon removal of the assembly the locations of the chalk dot markers are indicated by residual chalk dots on the surface wherein holes may be drilled thereby enabling attachment of the assembly thereon.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In as much as the foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the disclosed specific methods and structures may be readily utilized as a basis for modifying or designing other structures for carrying out the same purposes of the present invention. It should be realized by those skilled in the art that such equivalent methods and structures do not depart from the spirit and scope of the invention as set forth in the appended claims.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

Therefore, it is an object of the present invention to provide an improved chalk dot marker having a chalk or chalklike marking material disposed within and not requiring external application of dyestuffs of chalk materials.

It is therefore an additional object of the present invention to provide a new and improved chalk dot marker which has all the advantages of the prior art marker devices and none of the disadvantages.

It is another object of the present invention to provide a new and improved chalk dot marker which may be easily and efficiently manufactured and marketed.

It is a further object of the present invention to provide a new and improved chalk dot marker which is of a durable and reliable construction.

An even further object of the present invention is to provide a new and improved chalk dot marker which is susceptible of a low cost of manufacture with regard to both materials and labor, and which accordingly is then susceptible of low prices of sale to the consuming public, thereby making such chalk dot markers economically available to the buying public.

Still yet another object of the present invention is to provide a new and improved chalk dot marker which provides in the apparatuses and methods of the prior art some of the advantages thereof, while simultaneously overcoming some of the disadvantages normally associated therewith.

Still another object of the present invention is to provide a new and improved chalk dot marker adhesively applied to an assembly and producing drill hole site markings in a surface of installation by applying force to the assembly.

Yet another object of the present invention is to provide a new and improved chalk dot marker capable of being repositioned upon a surface of installation without producing a chalk mark until positive force is applied thereon.

Even still another object of the present invention is to provide a new and improved chalk dot marker for one time use and furthermore being available in sheet form wherein a sheet may comprise a plurality of chalk dot markers susceptible to simple removal and use.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention. The foregoing has outlined some of the more pertinent objects of this invention. These objects should be construed to be merely illustrative of some of the more prominent features and applications of the present invention. Many other beneficial results can be attained by applying the disclosed invention in a different manner or by modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
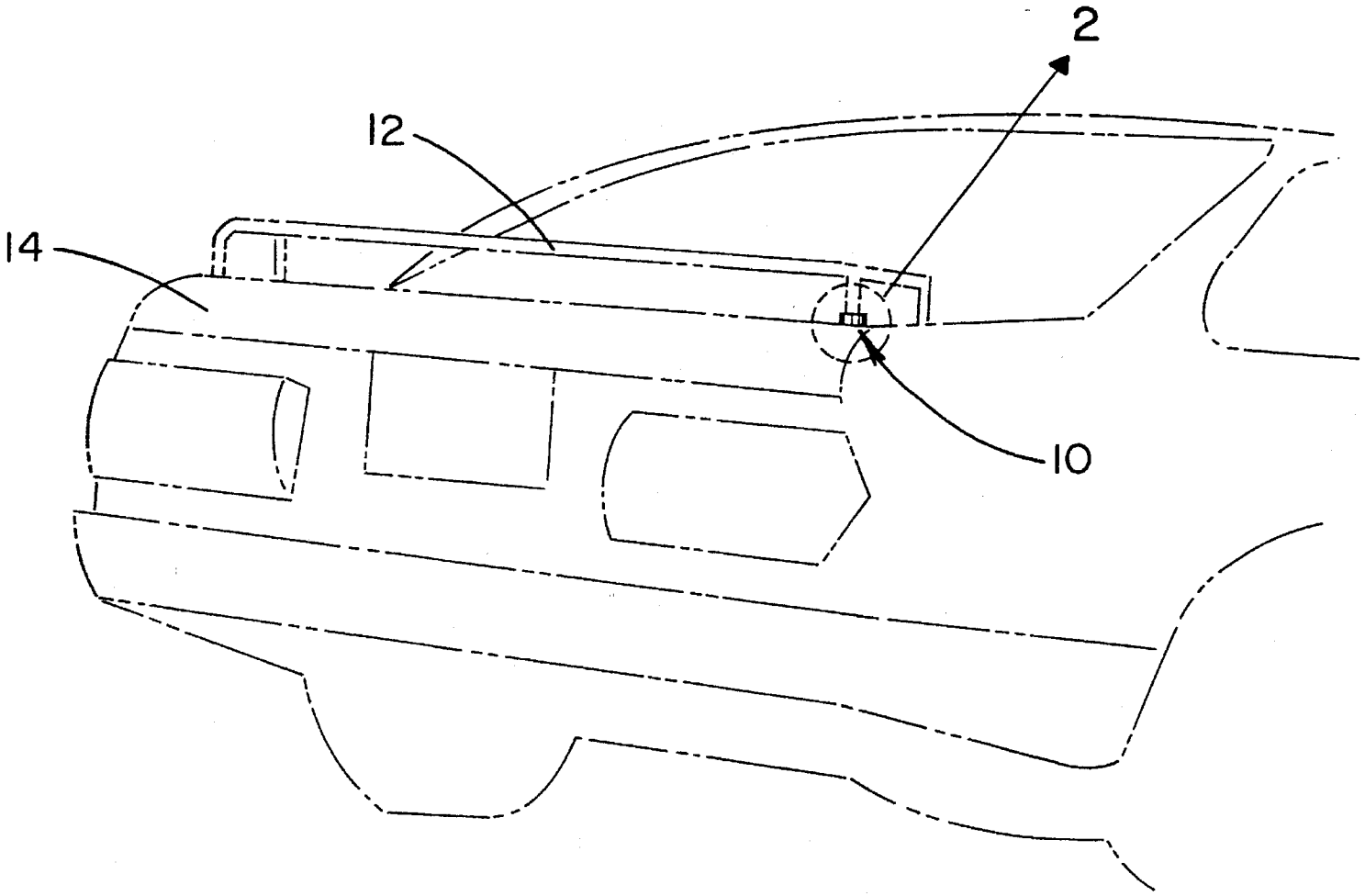
FIG. 1 is a perspective view of the chalk dot marker showing employment for marking drill holes upon a motor vehicle.

With reference now to the drawings, and in particular to FIG. 1 thereof, a new and improved chalk dot marker embodying the principles and concepts of the present invention and generally designated by the reference numeral 10 will be described.

From an overview standpoint, the chalk dot marker 10 is adapted for use with assemblies 12 or other structures which are to be installed using drilled holes. Assembly 12 has a chalk dot marker 10 adhesively affixed to a portion thereof which is a site for threaded engagement of a bolt member penetrating motor vehicle surface 14. See FIG. 1. Assembly 12 may be repositioned to gain best alignment whereupon pressure applied to assembly 12 activates chalk dot marker 10 thereby generating a chalk marking upon surface 14 indicative of a site for drilling.

Figure 2:
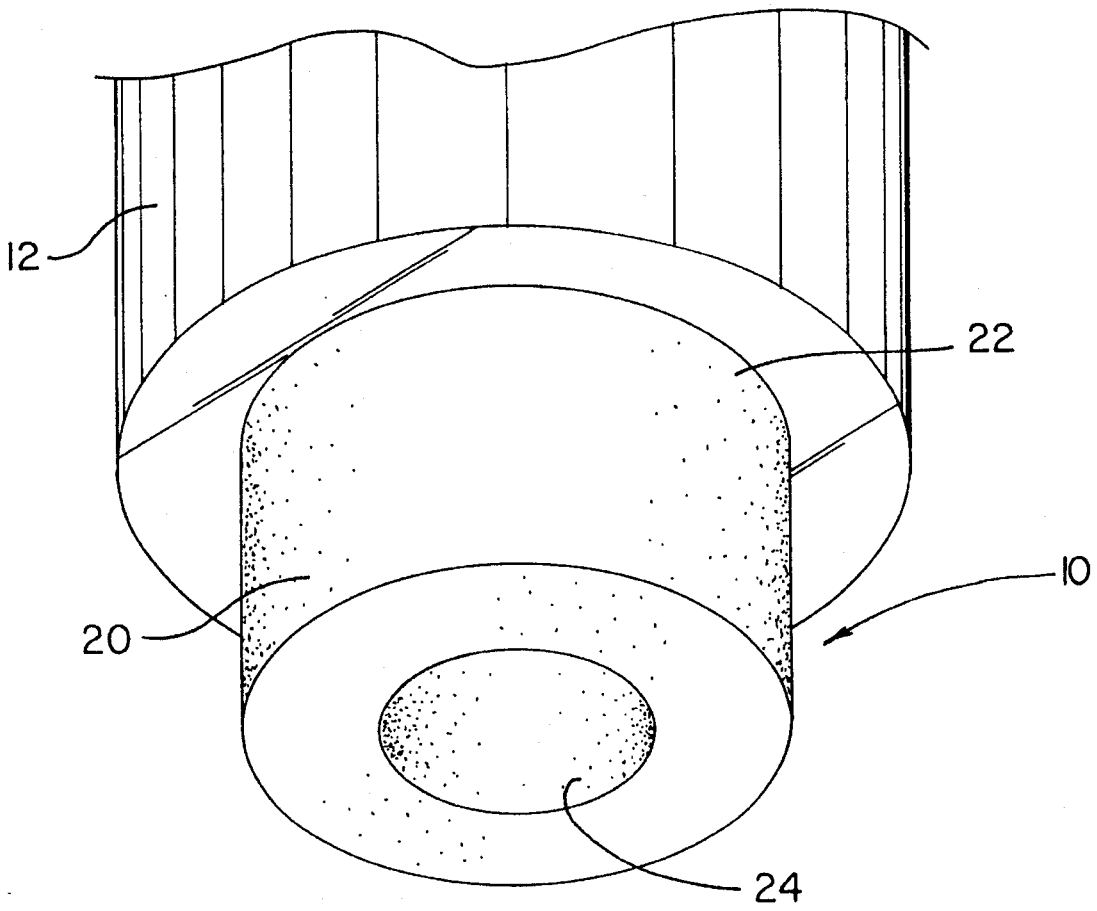
FIG. 2 is a perspective view of the chalk dot marker indicated by the numeral 2 of FIG. 1 and furthermore shown affixed to an assembly.
Figure 3:
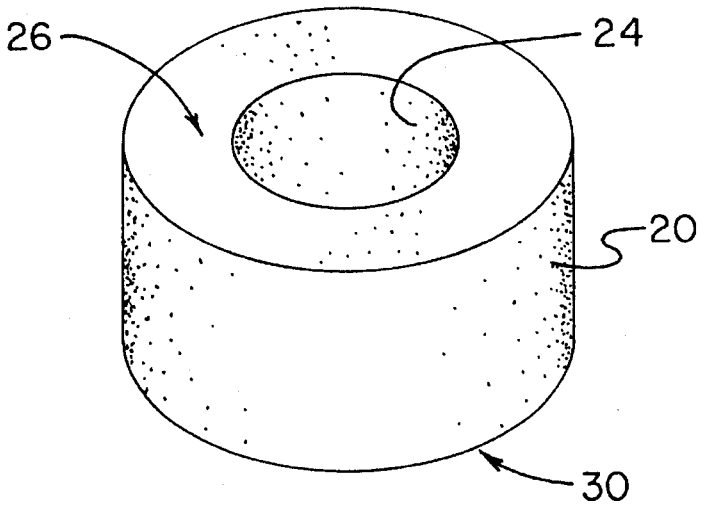
FIG. 3 is side elevational view of the chalk dot marker.
Figure 4:
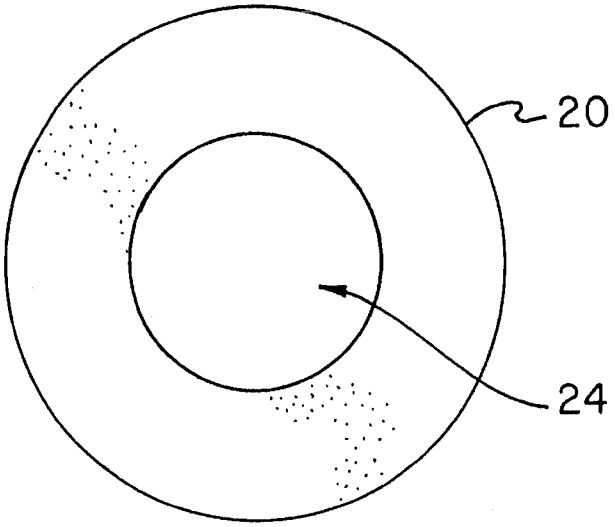
FIG. 4 is a side elevational view of the chalk dot marker.
Figure 5:
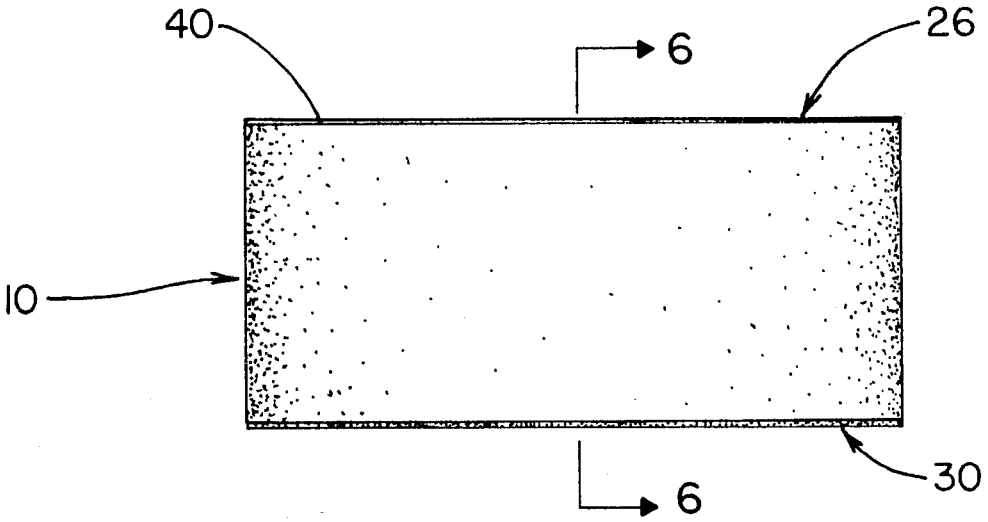
FIG. 5 is a side elevational view of a chalk dot marker.

More specifically, it will be noted that the chalk dot marker 10 comprises a cylinder 20 adhering at an end 22 thereof to a portion of assembly 12. See FIG. 2. Cylinder 20 comprises a soft foamlike material impregnated with chalk powder or a suitable dye material which is generally released into cylinder central portion 24 upon compression of cylinder 20 wherein compression results in a reduction in the separation of cylinder first end surface 26 and cylinder second end surface 30. See FIG. 3. Cylinder central portion 24 is generally an open cylinder and may be produced in various diameters wherein a particular cylindrical diameter therein produces a corresponding chalk mark dot on surface 14. The addition of various colored chalks or dyes provides color coding as an alternative option to identify particular hole sizes or hole types. For example, red chalk may indicate a ¼ inch hole and blue chalk a ⅛ inch hole. Cylinder 20 composition may be foam rubber, foam polyurethane, or several alternate materials having resiliency and a plurality of open pores which trap chalk dust therein for dispersion as a chalk dot on a surface 14. Suitable dye materials include powders such as colored talc or a plurality of microspheres internally filled with a dye material. Dye filled microspheres are ejected within cylinder central portion 24 when cylinder 20 is compressed whereupon the microspheres fracture upon contacting surface 14 releasing the dye contained therein and forming a marking thereon. See FIG. 4.

Cylinder first end surface 26 is coated with an impermeable membrane 40 adhesively affixed thereon. The impermeable membrane 40 is employed to prevent chalk or dye transfer to surface 14 in the absence of purposefully applied compressive forces, and to define a circular spot formation for the chalk mark. In the absence of impermeable membrane 40 the chalk dot marker 10 would produce a circular mark on surface 14 upon initial contact. Impermeable membrane 40 permits a substantial repositioning of assembly 12 before purposefully producing a chalk mark by applying pressure thereupon.

Figure 6:
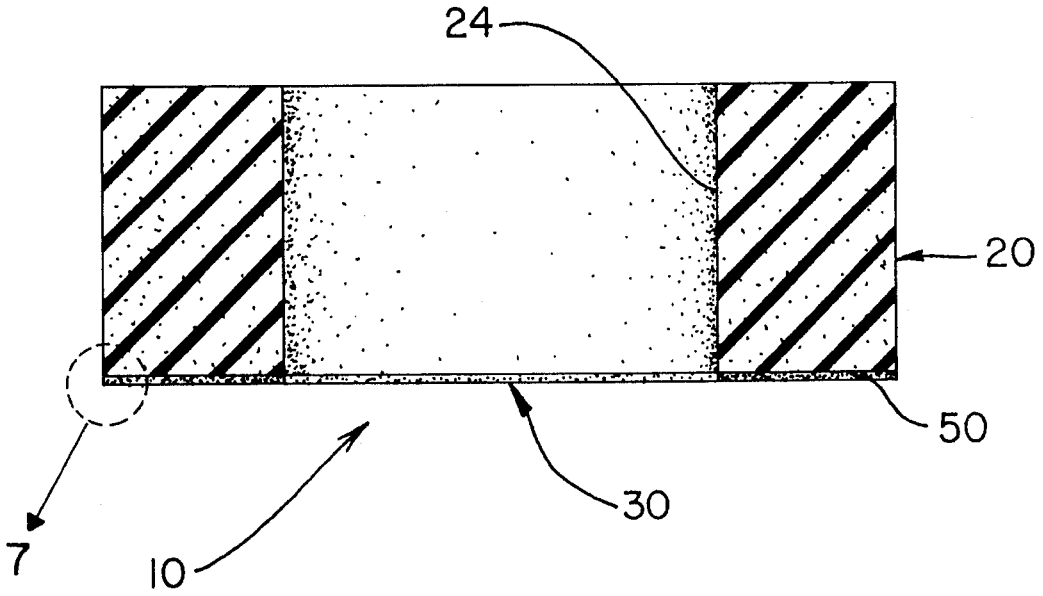
FIG. 6 is a side sectional view of the chalk dot marker taken substantially upon the plane indicated by the section line 6—6 of FIG. 5.
Figure 7:
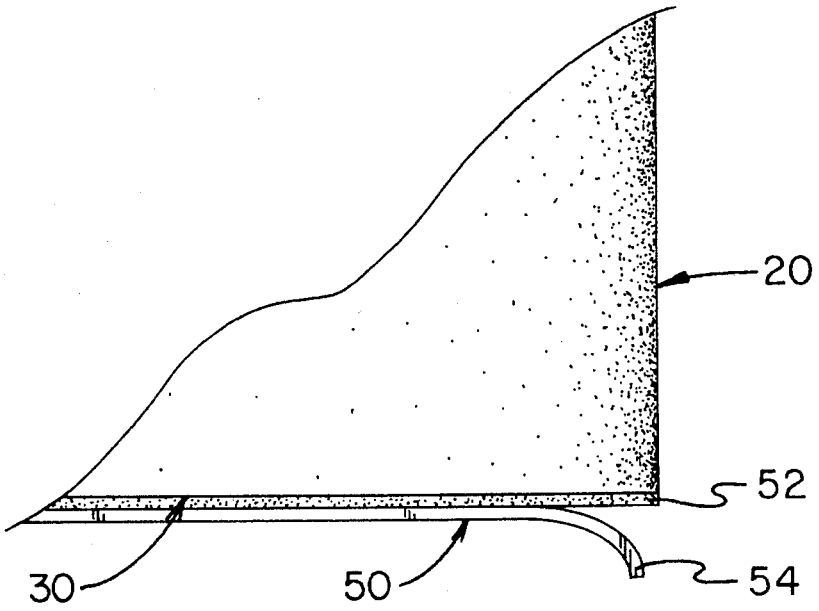
FIG. 7 is a fragmentary side elevational view of a chalk dot marker indicated by the numeral 7 of FIG. 6 and showing a partially uncovered adhesive surface.

Cylinder second end surface 30 has an adhesive layer 50 applied thereon. Adhesive layer 50 comprises a mutually adhering layer 52 and a strippable protective covering 54. See FIGS. 6 and 7. Strippable protective covering 54 comprises a paperlike material having a property of not permanently affixing to mutually adhering layer 52. Mutually adhering layer 52 is permanently bound to second end surface 30 and is detachably adherent to strippable protective covering 54 and substantially any other surface which is contacted thereon. Strippable protective covering 54 preserves a clean, dry adhesive surface for application of the chalk dot marker 10 to an assembly whereupon the covering 54 is stripped free of mutually adhering layer 52 and discarded just prior to said application thereupon.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention. In as much as the present disclosure includes that contained in the appended claims as well as that of the foregoing description. Although this invention has been described in its preferred forms with a certain degree of particularity, it is understood that the present disclosure of the preferred form has been made only by way of example and numerous changes in the details of construction and combination and arrangement of parts may be resorted to without departing from the spirit and scope of the invention.

What is claimed as being new and desired to be protected by LETTERS PATENT of the United States is as follows:

1. A new and improved chalk dot marker for marking drill sites on a surface comprising:

a cylindrical ring of soft foamlike material having first and second opposing end portions and a marking substance embedded therein;

an impermeable membrane covering said first end portion of said cylindrical ring wherein the impermeable membrane precludes said marking substance from transferring therethrough;

an adhesive layer covering said second end portion of said cylindrical ring wherein said adhesive layer is detachably adherent to most materials; and an adhesive layer protective member comprising a thin membrane applied to said adhesive layer and being capable of strippable removal therefrom.

2. The new and improved chalk dot marker of claim 1 in which said cylindrical ring of soft foamlike material comprises a polymeric foam cylinder having a circular cross section, a central hole therethrough, and wherein said first and second end portions are a pair of parallely disposed planar end surfaces thereon.

3. The new and improved chalk dot marker of claim 1 in which said marking substance comprises a powdered chalk-like material.

4. The new and improved chalk dot marker of claim 1 in which said marking substance comprises marking materials encapsulated within a plurality of tiny frangible spheroids.

5. The new and improved chalk dot marker of claim 1 in which said impermeable membrane comprises a plastic film bonded to said foamlike material.

6. The new and improved chalk dot marker of claim 1 in which said marking substance employed comprises a material having one of a variety of colors.

7. The new and improved chalk dot marker of claim 1 wherein a plurality of said chalk dot marker are provided on a single sheet prior to use and are useable when an individual one of said chalk dot markers is manually removed from the sheet.

* * * * *